US008161654B2

(12) United States Patent
Green

(10) Patent No.: US 8,161,654 B2
(45) Date of Patent: Apr. 24, 2012

(54) FOUR POINT UTILITY BLADE AND METHOD

(75) Inventor: Matthew C. Green, Amherst, MA (US)

(73) Assignee: Irwin Industrial Tool Company, Huntersville, NC (US)

( * ) Notice: Subject to any disclaimer, the term of this patent is extended or adjusted under 35 U.S.C. 154(b) by 799 days.

(21) Appl. No.: 12/204,751

(22) Filed: Sep. 4, 2008

(65) Prior Publication Data

US 2009/0064507 A1 Mar. 12, 2009

Related U.S. Application Data

(63) Continuation-in-part of application No. 11/409,459, filed on Apr. 20, 2006, now Pat. No. 7,921,568.

(51) Int. Cl.
*B26B 1/08* (2006.01)

(52) U.S. Cl. ..... 30/346.52; 30/346.53; 30/346.55; 30/346.59; 30/346.61; 76/104.1

(58) Field of Classification Search ..... 30/346.5, 30/346.53–346.61, 350–351; 76/104.1
See application file for complete search history.

(56) References Cited

U.S. PATENT DOCUMENTS

| | | | |
|---|---|---|---|
| 1,734,554 | A | 11/1929 | Behrman |
| 2,319,607 | A | 1/1943 | Kevorkian et al. |
| 3,439,419 | A | 4/1969 | Fleming |
| 3,448,518 | A | 6/1969 | Sklar |
| 3,889,368 | A | 6/1975 | Himeno |
| 4,170,062 | A | 10/1979 | Machida |
| 4,232,445 | A | 11/1980 | Ito |
| 4,233,734 | A | 11/1980 | Bies |
| 4,240,202 | A | 12/1980 | Gilbert |
| 4,292,738 | A | 10/1981 | Osada |
| 4,322,885 | A | 4/1982 | Osada |
| 4,729,168 | A | 3/1988 | Yeh |
| 4,794,692 | A | 1/1989 | Wang |
| 5,077,901 | A | 1/1992 | Warner et al. |

(Continued)

FOREIGN PATENT DOCUMENTS

DE 1924296 * 9/1965

OTHER PUBLICATIONS

International Search Report and the Written Opinion of the International Searching Authority for International Application No. PCT/US2009/055783.

*Primary Examiner* — Maurina Rachuba
(74) *Attorney, Agent, or Firm* — McCarter & English, LLP

(57) ABSTRACT

A utility blade for use with conventional retractable and fixed blade utility knives comprising a blade body having a generally trapezoidal configuration defined by a cutting edge, an opposite back edge, a pair of opposing side edges and a pair of cutting points defined by the points of intersection between the side edges and the cutting edge. The blade further defines a pair of score lines, each proximate to one of the side edges. The score lines enable the user to remove a dulled or damaged cutting point, which in turn provides the user with two additional cutting points defined by the points of intersection between the score lines and the cutting edge. Further, the blade is configured with one or more notches strategically located on the back edge of the blade, such that each cutting point can extend from the utility knife at approximately the same distance.

24 Claims, 10 Drawing Sheets

U.S. PATENT DOCUMENTS

| | | | |
|---|---|---|---|
| 5,103,564 | A | 4/1992 | MacDonald |
| 5,269,063 | A | 12/1993 | Okada |
| 5,337,482 | A | 8/1994 | Schmidt |
| 5,581,890 | A | 12/1996 | Schmidt |
| D400,067 | S | 10/1998 | Gold |
| D406,220 | S | 3/1999 | Schmidt |
| D406,221 | S | 3/1999 | Schmidt |
| 5,909,930 | A | 6/1999 | Ragland et al. |
| 6,226,873 | B1 | 5/2001 | Okumura |
| 6,263,577 | B1 | 7/2001 | Wonderley |
| 6,324,762 | B1 | 12/2001 | Huang |
| D455,057 | S | 4/2002 | Medhurst |
| 6,438,849 | B1 | 8/2002 | Wonderley |
| 6,510,612 | B1 | 1/2003 | Cybulski |
| D479,108 | S | 9/2003 | Schmidt |
| 6,701,627 | B2 | 3/2004 | Korb et al. |
| 6,718,640 | B1 | 4/2004 | John |
| 6,938,345 | B2 | 9/2005 | Yu |
| D527,234 | S | 8/2006 | Weremchuk et al. |
| 7,208,216 | B2 | 4/2007 | Ackerman et al. |
| D562,651 | S | 2/2008 | Harkey et al. |
| D568,126 | S | 5/2008 | Allem |
| D582,229 | S | 12/2008 | Johnson |
| D623,911 | S | 9/2010 | Allem |
| 2003/0019111 | A1* | 1/2003 | Korb et al. ..... 30/351 |
| 2003/0019332 | A1 | 1/2003 | Korb et al. |
| 2004/0168326 | A1 | 9/2004 | Korb et al. |
| 2004/0244539 | A1 | 12/2004 | Korb et al. |
| 2005/0022390 | A1 | 2/2005 | Whitemiller et al. |
| 2005/0050734 | A1 | 3/2005 | Kesinger |
| 2006/0053631 | A1 | 3/2006 | Fossella |
| 2007/0101576 | A1 | 5/2007 | Green |
| 2007/0227012 | A1 | 10/2007 | Constantine et al. |
| 2007/0245574 | A1 | 10/2007 | Green |
| 2008/0295344 | A1 | 12/2008 | Giola |
| 2009/0106909 | A1 | 4/2009 | Tyers |

* cited by examiner

FOUR POINT UTILITY BLADE AND METHOD

CROSS-REFERENCE TO PRIORITY APPLICATION

This patent application is a continuation-in-part under 35 U.S.C. §120 of U.S. patent application Ser. No. 11/409,459, filed Apr. 20, 2006 now U.S. Pat. No. 7,921,568, entitled "FOUR POINT UTILITY BLADE", which is hereby incorporated by reference in its entirety as part of the present disclosure.

FIELD OF THE INVENTION

The present invention relates to utility knife blades, more particularly, to conventional utility knife blades having one or more score lines that allow the user to snap off a dulled point in a relatively precise location, thereby providing the user with more than two useful cutting points.

BACKGROUND

Conventional utility knives having disposable utility blades are well known in the art. These knives have many industrial as well as home uses, such as for opening boxes, cutting cord, or carving wall board or wood. A typical utility knife has a plastic or metal handle with either a fixed or retractable utility blade mounted therein. When in use, the blade is positioned to extend outwardly from the handle, exposing the cutting edge and one of the cutting points of the blade.

Utility knife blades come in a variety of shapes depending upon the intended use. As shown with reference to FIG. 1, a conventional utility blade has a generally trapezoidal shape that includes a back edge, a cutting edge and two side edges. The trapezoidal shaped blades are the most popular because they define sharp acute angled cutting points or tips formed at the intersections between the side edges and the cutting edge. These sharp points or tips enable a user to puncture through a material which is desired to be cut, such as sealing tape closing a box or the cardboard defining the box. Once the object has been punctured, the user can slice open the material by dragging the knife along the surface of the material and allowing the cutting edge to cut through the material.

Although trapezoidal utility blades are preferred for the reasons described above, they offer the disadvantage that the tips will dull or become damaged over a period of repeated uses, rendering the blade worn out or spent. When this occurs, users that require a sharply pointed blade cutting tip will either replace the blade with a new blade, which adds to overall supply costs and material waste, or, to save money, will attempt to prolong the useful life of a spent blade by manually snapping or snipping off the end of a dulled point blade, effectively creating a new sharp cutting point. This practice is particularly cumbersome because the user has little control over where the blade will actually snap; additionally, such a practice creates a safety hazard, as the blade can shatter and project sharp metallic pieces that could harm the user or a bystander. Furthermore, this practice is even more cumbersome with respect to bi-metal utility blades because the tip will not snap off manually thereby requiring the use of a cutting tool to renew the tip.

To address this disadvantage, conventional snap-off style utility blades have been developed that employ an elongated blade having a plurality of blade segments separated by score lines that allow the user to snap off a spent blade segment at the respective score line. However, such snap-off style utility blades require a specialized blade holder and utility knife housing to secure, move and index the blade, and cannot be used with conventional retractable and fixed blade utility knives that use conventional trapezoidal utility blades.

There is a need, therefore, for an improved utility knife blade that overcomes one or more of the above-described drawbacks and/or disadvantages of conventional prior art utility knife blades and conventional prior art snap-off style utility knife blades.

SUMMARY

The utility blade herein described is designed for use with conventional retractable and fixed blade utility knives and provides the user with more than two, and in one embodiment, four useful cutting points as opposed to the standard two cutting points found in conventional trapezoidal utility blades (FIG. 1). With the availability of more than two cutting points, the life of an individual blade is prolonged, which in turn, reduces supply costs and material waste. Additionally, the blade may be configured with indexing notches that are strategically located so that each of the cutting points, when in use, will extend from the utility knife at about the same distance to provide the user with a consistent cutting edge and maintain blade stability, feel and control during use.

In accordance with one aspect of the utility knife blade herein described, the blade includes a generally planar blade body having a substantially trapezoidal peripheral configuration. The blade body defines a back edge, a cutting edge located on an opposite side of the blade body relative to the back edge, and two side edges located on opposite sides of the blade body relative to each other and extending between the back and cutting edges of the blade body. The intersection of each side edge with the cutting edge forms a first cutting point and a second cutting point. The utility blade further includes at least one score line and at least one removable cutting segment, thereby providing an additional cutting point when the segment is removed. In one embodiment, the blade includes a first score line and a second score line, each score line proximate to one of the side edges, and two removable cutting segments. Each cutting segment is defined by the area of the blade body between one of the score lines and the side edge proximate to the respective score line. The intersection of each score line and the cutting edge forms a third cutting point and a fourth cutting point when each of the respective cutting segments is removed.

According to another aspect of the utility knife blade herein described, each score line extends from either the cutting edge to the back edge, from the cutting edge to the side edge proximate to the respective score line, from the cutting edge to the point of intersection between the back edge and the side edge proximate to the respective score line, or any combination thereof. The utility blade further defines at least one notch formed in the back edge of the blade body.

In yet another aspect of the utility knife blade herein described, the blade further includes at least two, and in one embodiment, at least four notches formed in the back edge of the blade body and having a center point, wherein the notches are laterally spaced relative to each other. The blade further defines a distance D1 between at least one of the first and second cutting points and a blade aperture defined by the utility knife that the blade is mounted into, and a distance D2 between the center points of the notches. Still further, the blade defines a distance D3 between the first cutting point and a point defined by the intersection of the first score line and the cutting edge, as well as the distance between the second cutting point and a point defined by the intersection of the second score line and the cutting edge. The blade is configured so that D2 and D3 are approximately equal to one another such that, upon removal of the cutting segments, the blade can be indexed a distance D4, which is approximately equal to D1, so that the third and fourth cutting points can extend from the blade aperture at approximately the same distance D1 that the first and second cutting points extend from the same utility knife. In one embodiment, D2 and D3 are within the range of about 1/10 to about ½ inch.

In still another aspect of the utility knife blade herein described, each side edge and score line intersects the cutting edge at an acute angle, while the cutting edge defines an approximately straight edge extending from approximately one side edge of the blade to the other side edge, and at least two facets formed on opposite sides of the blade relative to each other.

In a further aspect of the utility knife blade herein described, the blade comprises first and second metal portions. The first metal portion extends between the back edge and the second metal portion, and extends from approximately one side edge to the other side edge, and the second metal portion defines the cutting edge and extends from approximately one side edge to the other side edge. In this embodiment, the first metal portion is formed of a steel heat treated to a hardness within the range of approximately 38 Rc to approximately 52 Rc, and the second metal portion is formed of a tool steel heat treated to a hardness within the range of approximately 60 Rc to approximately 75 Rc. The first and second metal portions are joined at a weld region that extends from approximately one side edge of the blade to the other side edge of the blade.

According to another aspect of the utility knife blade herein described, the utility knife blade includes a blade body defining a first side, a second side opposite the first side, a back edge, a cutting edge located on an opposite side of the blade relative to the back edge, a first side edge extending between the back and cutting edges of the blade, and a second side edge located on an opposite side of the blade relative to the first side edge and extending between the back and cutting edges of the blade. A first score line is located on the first side of the blade body proximate to the first side edge, and defines a first cutting edge segment between the first score line and the first side edge. A second score line is located on the second side of the blade body proximate to the second side edge, and defines a second cutting edge segment between the second score line and the second side edge.

According to another aspect of the utility knife blade herein described, the utility knife blade includes a blade body defining a first side, a second side opposite the first side, a back edge, a cutting edge located on an opposite side of the blade relative to the back edge, a first side edge extending between the back and cutting edges of the blade, and a second side edge located on an opposite side of the blade relative to the first side edge and extending between the back and cutting edges of the blade. A first means is located on the first side of the blade body proximate to the first side edge of the blade for defining a first cutting edge segment between the first means and the first side edge, and for breaking away the first cutting edge segment from the blade. A second means is located on the second side of the blade body proximate to the second side edge of the blade for defining a second cutting edge segment between the second means and the second side edge, and for breaking away the second cutting edge segment from the blade.

In accordance with another aspect, the present invention is directed to a method comprising the following steps:

providing a utility knife blade defining a conventional trapezoidal blade envelope for use in a conventional retractable or fixed blade utility knife defining a blade aperture, wherein the utility knife blade defines a plurality of score lines including a first score line located on a first side and end of the blade, and a second score line located on a second side and end of the blade opposite the first side and end of the blade, respectively, and each score line defines a respective cutting edge segment;

locating each score line exposed through the blade aperture of the utility knife on the same side of the utility knife regardless of which end of the utility knife blade is exposed through the blade aperture; and snapping each blade segment away from the blade by placing the respective score line in tension.

Some embodiments of the present invention further comprise snapping each blade segment away from the blade by bending the blade segment about, and facing the respective score away from the user. Some embodiments of the present invention comprise providing a marking on the utility knife blade and/or handle indicating a preferred direction of break at each respective score line One advantage of the utility knife blade herein described is that the blade provides more than two useful cutting points to the user and can be used with any conventional retractable blade and fixed blade utility knife. A further advantage of the currently preferred embodiments of the blade is that when a cutting segment is broken off at the score line, which in turn provides a fresh cutting point, the blade can be indexed or advanced forward so that the fresh cutting point protrudes from the knife opening at the standard blade extension; i.e., the fresh cutting point will extend from the utility knife at approximately the same distance as the previously broken off cutting point.

Other aspects and advantages of the present invention and/or of the currently preferred embodiments thereof will become more readily apparent in view of the following detailed description and accompanying drawings.

DETAILED DESCRIPTION

Figure 2:
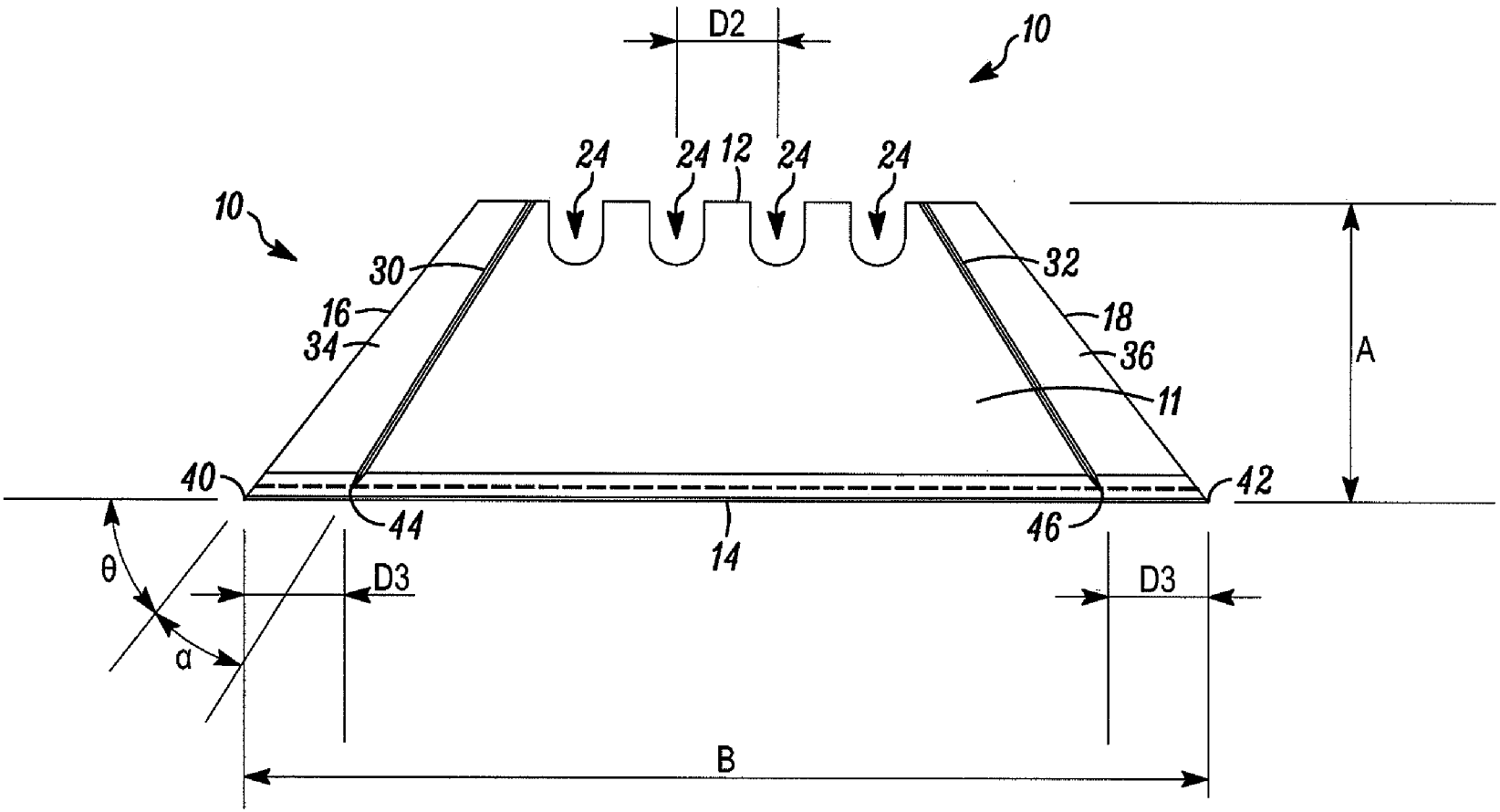
FIG. 2 is a side elevational view of an embodiment of a utility knife blade of the present invention.
Figure 4:
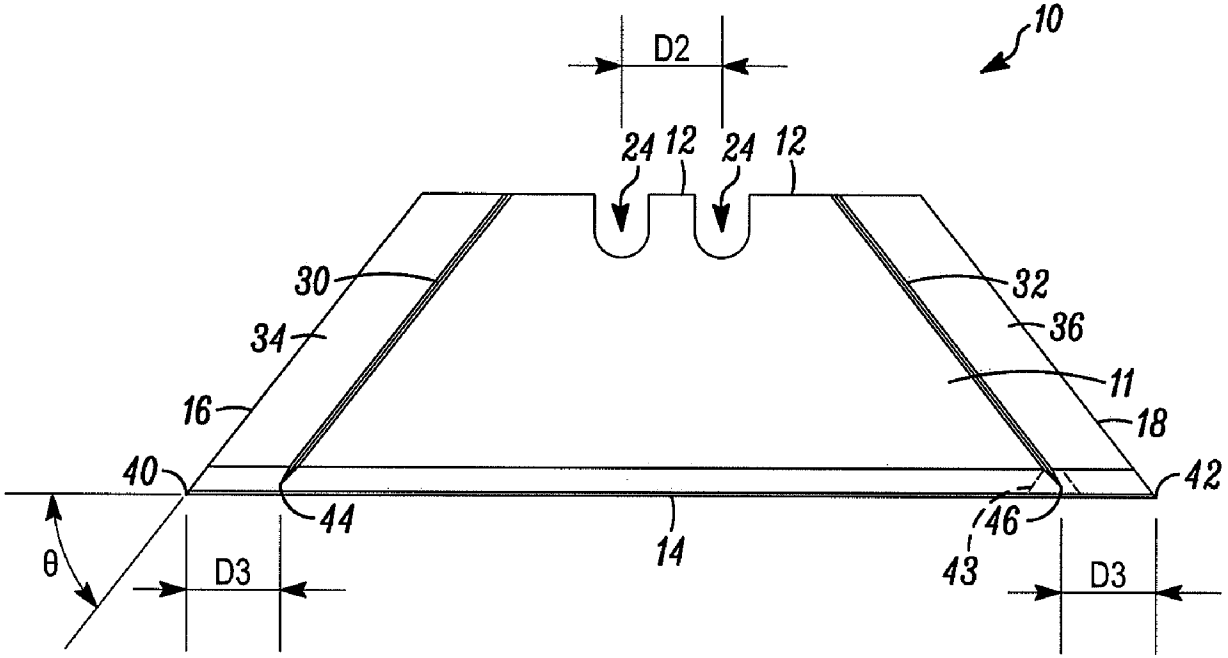
FIG. 4 is a side elevational view of another embodiment of the utility knife blade of the present invention.
Figure 5:
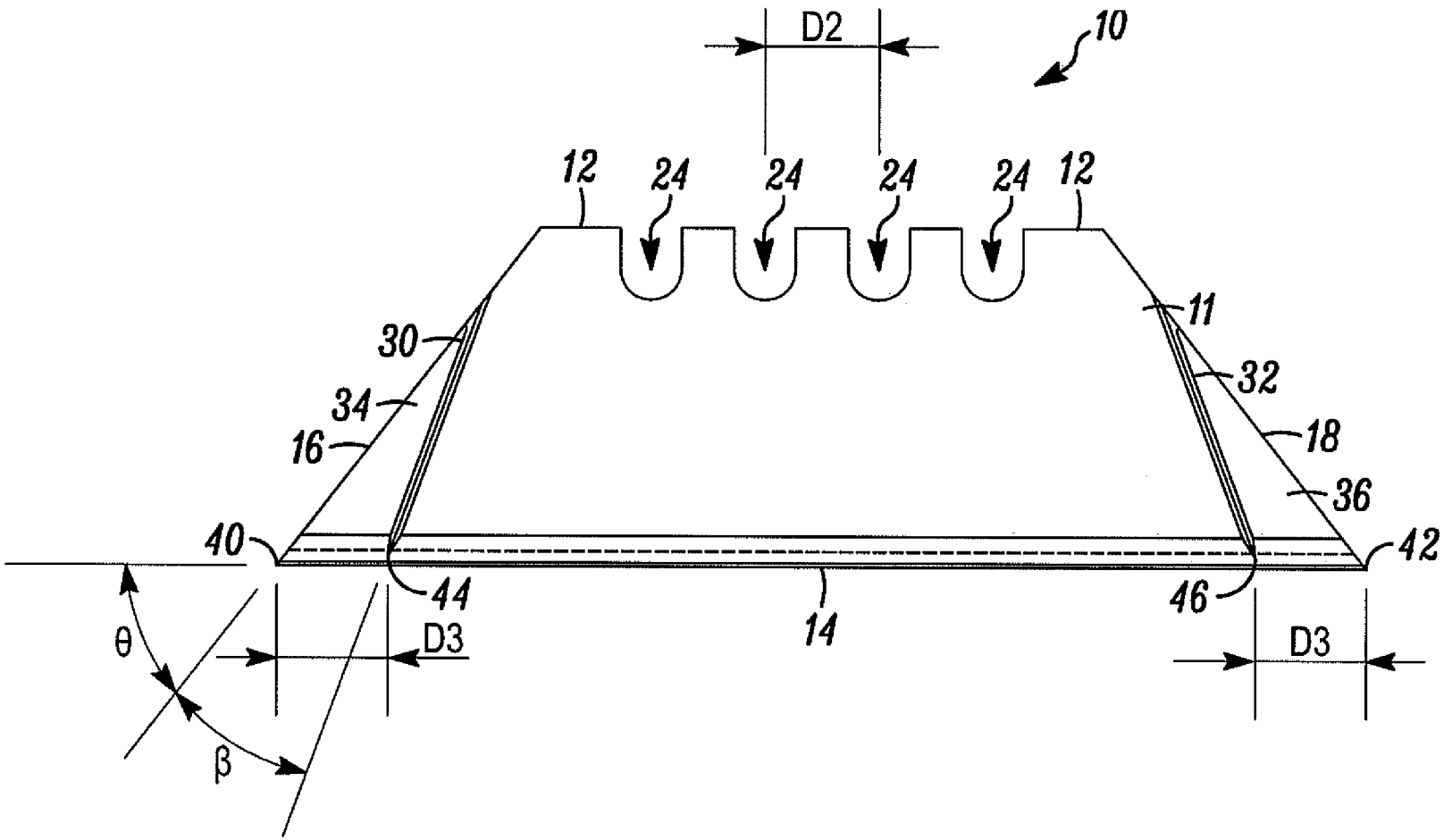
FIG. 5 is a side elevational view of another embodiment of the utility knife blade of the present invention.

In FIGS. 2, 4 and 5, a four-point or "Snap Trap™" utility knife blade herein described is indicated generally by the reference numeral 10. The blade is completely usable with conventional industry standard retractable and fixed blade utility knives that utilize conventional trapezoidal utility blades, but can also be used with additional utility knives and holders that are currently known or later become known. The utility knife blade 10 comprises a generally planar blade body 11 that defines a back edge 12, a cutting edge 14 located on an opposite side of the blade relative to the back edge, and two side edges 16, 18 located on opposite sides of the blade relative to each other and extending between the back and cutting edges of the blade 10. The intersection of each side edge 16, 18 and the cutting edge 14 forms a pair of primary cutting points, first cutting point 40 and second cutting point 42 respectively, which are typically used for cutting and puncturing work pieces. In one embodiment, the side edges 16, 18 intersect the cutting edge 14 at an acute angle θ in the range of about 22° to about 82°, more preferably in the range of about 32° to about 72°, and in an exemplary embodiment, the angle θ is approximately 52°.

Figure 3:
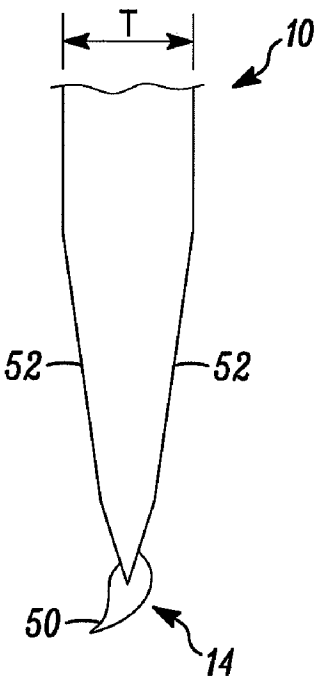
FIG. 3 is a partial, end elevational view of the utility knife blade of FIG. 2 showing the multi-faceted cutting edge of the blade.

As shown typically in FIG. 2, the back, cutting and side edges of the blade define an approximately trapezoidal peripheral configuration. The cutting edge 14 defines an approximately straight edge extending from approximately one side edge 16 of the blade to the other side edge 18, and at least two facets 50, 52 (shown in FIG. 3) formed on opposite sides of the blade relative to each other. As can be seen, the currently preferred embodiments of the utility knife blades of the present invention define a conventional or standard trapezoidal blade envelope or footprint for use with conventional or standard retractable and fixed blade utility knives. Conventional or standard utility knife handles typically define a blade receiving recess for receiving therein a conventional or standard utility blade, and the blade receiving recess defines a conventional or standard trapezoidal blade envelope. In order to fit within such a conventional or standard utility knife handle, the trapezoidal blade must define a conventional or standard trapezoidal envelope or footprint. Accordingly, as shown typically in FIG. 2, the currently preferred embodiments of the utility knife blade of the present invention define a conventional or standard trapezoidal envelope or footprint as follows: a height "A" that is within the range of about ¾ inch±about 1/16 inch; a length "B" of the cutting edge that is within the range of about 2½ inch±about ¼ inch; a side edge angle θ that is within the range of about 45° to about 55°; and a thickness "T" that is within the range of about 0.015 inch to about 0.05 inch (FIG. 3). In the illustrated embodiments, each blade defines a nominal thickness T of about 0.025 inch. A significant advantage of the utility knife blades of the present invention is that because they define a conventional or standard utility knife blade envelope they can be used in standard or conventional utility knife handles, and therefore allow such handles to use blades that define multiple snap-off cutting edge segments. Accordingly, the utility knife blades of the present invention overcome the drawback encountered in the prior art of requiring special "snap-off" style handles to employ blades with multiple snap-off cutting edge segments. As may be recognized by those of ordinary skill in the pertinent art based on the teachings herein, the utility knife blades herein described may take any of numerous different shapes or configurations that are currently known or that later become known, including, for example, a square or parallelogram shape, and can be single faceted or have more than two facets.

The blade 10 further defines a first score line 30 and a second score line 32, wherein each score line is proximate to one of the side edges 16,18. The score lines 30, 32 are configured such that they extend from the cutting edge 14 of the blade to the back edge of the blade 12 (FIGS. 2 and 4), from the cutting edge 14 of the blade to the side edge 16,18 of the blade proximate to the respective score line (FIG. 5), from the cutting edge 14 of the blade 10 to the point of intersection between the back edge and the side edge 16,18 proximate to the respective score line (not shown), or any combination thereof. Drawing further attention to FIGS. 2 and 4, it should be noted that the score lines 30, 32 can run substantially parallel to the side edges 16, 18 (FIG. 4), or can be offset at an angle within the range of about 1° to about 90°. In the embodiment shown in FIG. 2, the score lines are offset at an angle α within the range of about 1° to about 30°, more preferably within the range of about 2° to about 10°, and in the exemplary embodiment of FIG. 2, the angle α is approximately 6°. In the embodiment shown in FIG. 5, the score lines are offset at an angle β within the range of about 1° to about 37°, more preferably within the range of about 9° to about 27°, and in the exemplary embodiment of FIG. 6, the angle β is approximately 18°.

Figure 1:
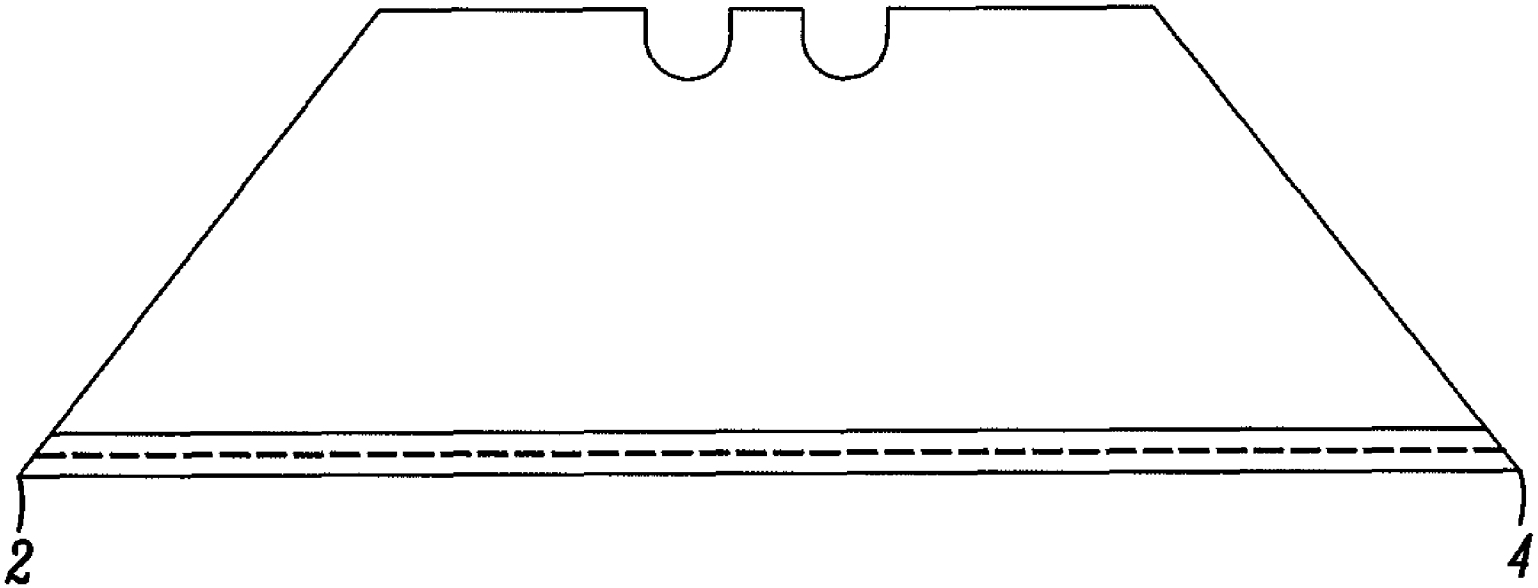
(PRIOR ART) FIG. 1
FIG. 1 is a side elevational view of a prior art trapezoidal utility knife blade.

With the score lines, the blade further defines two removable cutting segments 34, 36, each segment defined by the area of the blade body between one of the score lines and the side edge 16, 18 proximate to the respective score line. In this configuration, when either of the cutting segments 34, 36 becomes unusable due to dulling or breakage, the damaged or dulled segment may be manually snapped off at the respective score line 30, 32, subsequently exposing a pair of secondary cutting points, namely, third cutting point 44 and/or fourth cutting point 46. Each secondary cutting point 44, 46 is defined by the point of intersection between each score line 30, 32 and the cutting edge 14. With this configuration, the blade user is provided with four useful cutting points 40, 42, 44, 46 as opposed to the standard two cutting points 2, 4 found on conventional utility knife blades 1 (FIG. 1). It should be noted, however, that although the embodiments shown in FIGS. 2 and 4 through 6 include two score lines and two cutting segments (one score line and one cutting segment on each side of the blade), the blades can have only one score line and cutting segment, or two or more score lines and respective cutting segments, so long as the blade remains functional with conventional retractable and fixed blade utility knives.

To engage conventional retractable and fixed blade utility knives, the utility knife blade 10 includes at least one indexing notch 24 formed in the back edge 12 of the blade body 11. In one embodiment (FIG. 4), the blade 10 includes at least two notches 24 formed in the back edge 14 of the blade body 11, wherein each notch 24 defines a center point and the notches are laterally spaced relative to each other. In another embodiment (FIGS. 2 and 5), the blade 10 includes at least four notches 24 formed in the back edge 14 of the blade body 11, wherein each notch 24 has a center point and the notches are laterally spaced relative to each other. As shown typically in FIGS. 2, 4 and 5, each notch 24 defines a concave, approximately semi-circular profile, and is adapted to engage a corresponding locator 90 (FIGS. 7 and 8) of a blade holder within a utility knife in order to retain the blade within the handle of the knife. As may be recognized by those skilled in the pertinent art based on the teachings herein, the notches 24 may take any of numerous different shapes and/or configurations, and the blade may include any number of such notches or other recesses that are currently or later become known to those skilled in the pertinent art for performing the function of engaging a blade holder, or the blade actuating mechanism or locator of such a holder for any and all conventional retractable and fixed blade utility knives that are currently known or later become known.

Figure 7:
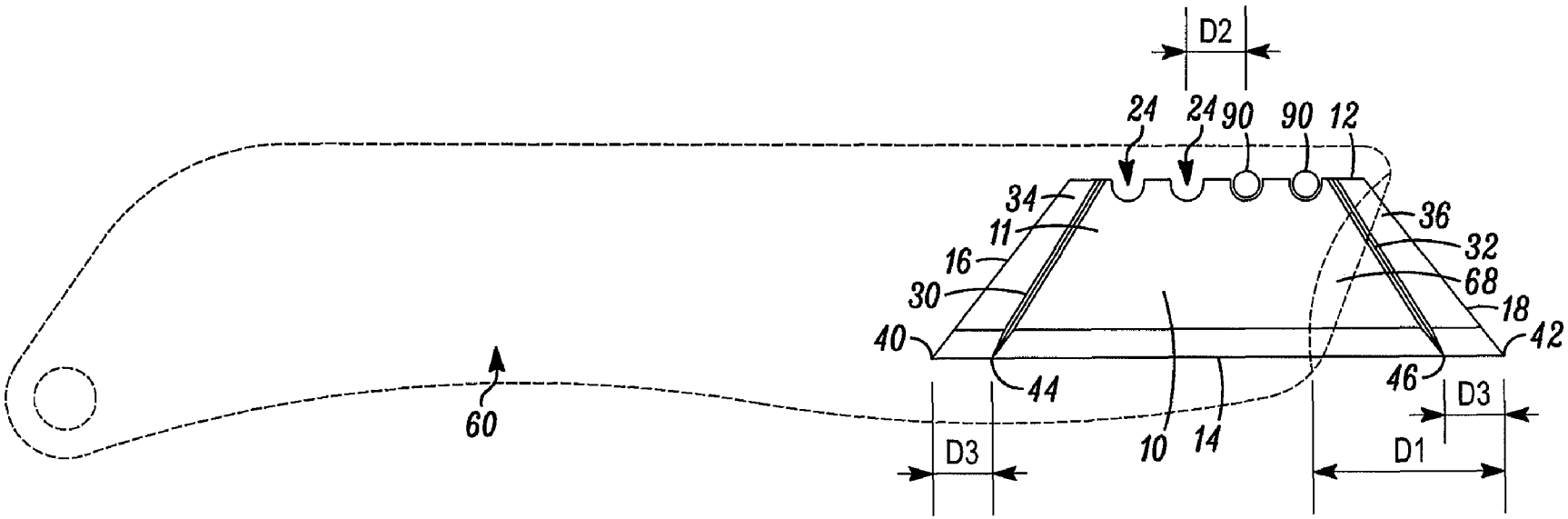
FIG. 7 is a side elevational view of the utility blade of FIG. 2 mounted to a conventional utility knife and indexed so that one of the primary cutting points is exposed.
Figure 8:
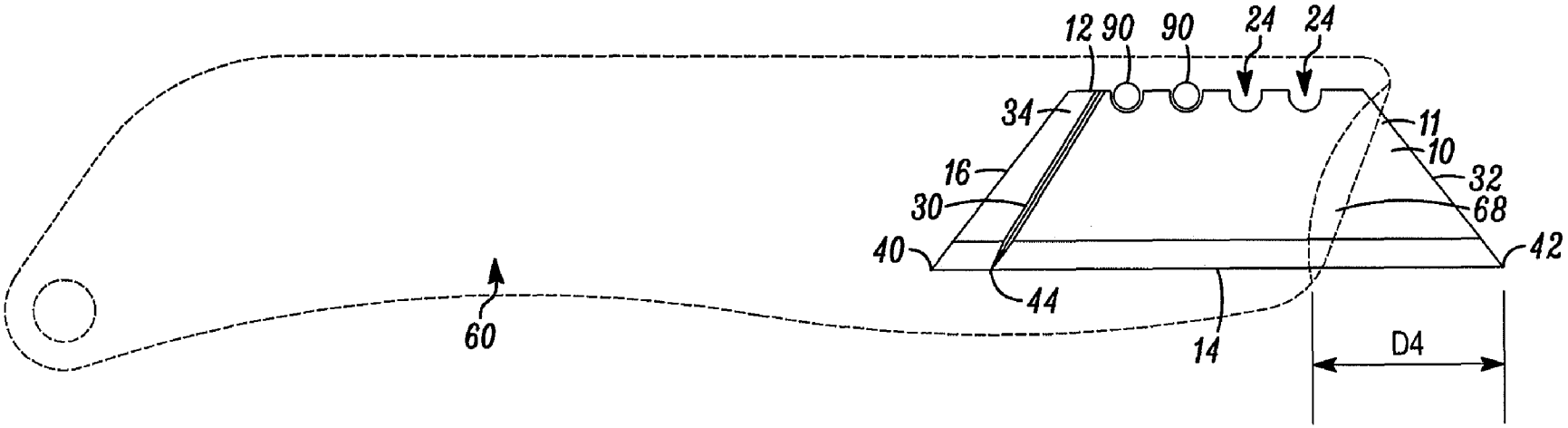
FIG. 8 is a side elevational view of the utility blade of FIG. 2 mounted to a conventional utility knife and indexed so that one of the secondary cutting points is exposed upon removal of a cutting segment.

With reference to FIGS. 2, 4, 5, 7 and 8, the characteristics of the blade 10 with respect to blade positioning and indexing in conventional retractable and fixed blade utility knives is hereinafter described. FIG. 7 illustrates the blade 10 of FIG. 2 seated within a utility knife handle 60 with the notches 24 of the blade engaging the blade-engaging locators, tabs or catches 90 of the utility knife, wherein the first cutting point 40 is extended a distance D1 (described in further detail below) from a blade aperture 68 defined by the utility knife handle 60. When the extended portion of the cutting edge 14 of the blade 10 becomes damaged or dulled, the user can flip the blade over and use the other half of the blade, or the user can snap off the dulled segment at one of the score lines 30, 32 to expose one of the secondary cutting points 44, 46. As shown typically in FIGS. 7 and 8, and in contrast to prior art snap-off blade holders, the score lines 30, 32 are oriented transverse to the front edge of the utility knife handle defining the blade aperture 68. For example, the score lines and front edge defining the blade aperture in the utility knife handle substantially lie within planes that intersect one another. In the illustrated embodiment, each score line is oriented transversely relative to the front edge of the utility knife handle defining the blade aperture 68 at an acute angle that is within the range of about 25° to about 75°, and preferably within the range of about 40° to about 60°. As may be recognized by those of ordinary skill in the pertinent art based on the teachings herein, the utility blades 10 herein described are usable with any of the numerous different styles of conventional retractable and fixed blade utility knife configurations that are currently known or later become known.

The blade 10 defines a distance D1 (FIG. 7) between the first and second primary cutting points 40, 42 and the blade aperture 68 of the utility knife that the blade is mounted into (see FIGS. 7 and 8), and a distance D2 between the center points of the notches 24. Additionally, the blade 10 defines a distance D3 between the first cutting point 40 and the third cutting point 44, and between the second cutting point 42 and the fourth cutting point 46, respectively. In an exemplary embodiment, D2 and D3 are approximately equal so that when a primary cutting point 40, 42 becomes damaged or dulled and the respective cutting segment 34, 36 is removed, the blade 10 can be indexed or advanced forward such that the secondary (i.e., third and fourth) cutting point 44, 46 can extend from the blade aperture 68 a distance D4 (FIG. 8), which is approximately equal to the distance D1 (FIG. 7) that the first and second cutting points 40, 42 extend from the same blade aperture 68. This configuration provides a sharp cutting point, whether primary 40, 42, or secondary 44, 46, at approximately the same blade extension, which gives the user a consistent length of cutting edge to work with and better blade stability, feel and control during use. In one embodiment of the invention, D2 and D3 are approximately 1/10 to ½ inch, and in an exemplary embodiment, D2 and D3 are approximately ¼ inch. It should be noted, however, that any of the aforementioned distances, D1, D2, D3 and D4, can be adjusted in any way and are not limited to the description above. Furthermore, in instances where more than two notches are employed, the distances between the center points of the notches can vary, whether the notches are spaced at equidistant intervals along the back edge or at random or non-equidistant intervals.

To assist the user in manually removing each of the cutting segments 34, 36 when the respective primary cutting points 40, 42 become dulled or damaged, the blade 10 can optionally include at least one notch 43 formed at the juncture of the respective score line 30, 32 and cutting edge 14, shown in broken lines in FIG. 4, to facilitate breaking off and removing the respective cutting segment 34, 36 from the blade 10. The blade 100 may define any of a variety of alternative or additional apertures in the blade body. The functions of such apertures may be dependent upon the internal configuration of a respective utility knife handle, and may be used, for example, for centering, stabilizing, and/or indexing the blade within the respective utility knife handle.

Figure 6:
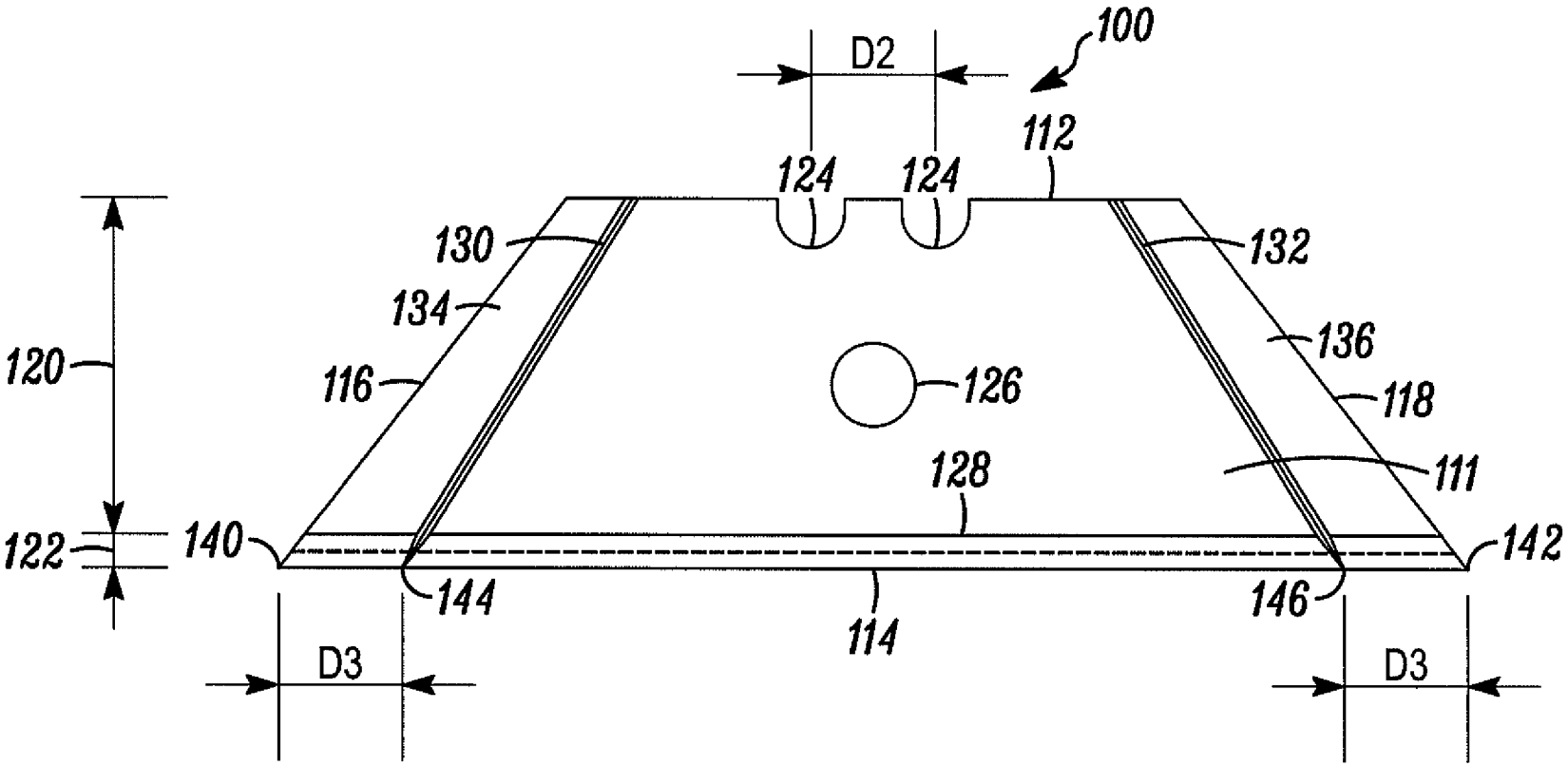
FIG. 6 is a side elevational view of a composite utility knife blade according to another embodiment of the invention.

In another embodiment of the utility knife blade herein described, the blade 10 is a composite utility knife as shown in FIG. 6. The blade 10 in this embodiment incorporates all of the features and advantages previously shown or described with respect to the embodiments of FIGS. 2-5 and FIGS. 7-8 and, therefore, can be used in conjunction with conventional industry standard retractable and fixed blade utility knives.

In the embodiment shown in FIG. 6, the blade 100 defines a back edge 112, a cutting edge 114 located on an opposite side of the blade relative to the back edge, and two side edges 116, 118 located on opposite sides of the blade relative to each other and extending between the back and cutting edges of the blade. As shown typically in FIG. 6, the back, cutting and side edges of the blade preferably define an approximately trapezoidal peripheral configuration. Additionally, the blade 100 defines a pair of score lines 130, 132, each of which is proximate to one of the side edges 116, 118 as shown. It should be noted that the score line configurations can vary as described above, so that the score lines 130, 132 can extend from the cutting edge 114 to the back edge 112 (as shown), from the cutting edge to the side edge (not shown), from the cutting edge to the point of intersection between the back and respective side edges (not shown), or any combination thereof; additionally, the score lines 130, 132 can run approximately parallel to the side edges (not shown) or can run offset in a non-parallel manner (FIG. 6) as noted above. The blade 100 also defines at least one cutting segment and at least three cutting points and, in one embodiment, the blade 100 defines two cutting segments 134, 136 and four cutting points 140, 142, 144, and 146, all of which are defined in the same or similar manner as previously described.

The blade 10 further defines a first metal portion 120 and a second metal portion 122. As shown typically in FIG. 6, the first metal portion 120 extends between the back edge 112 and the second metal portion 122, and further extends from approximately one side edge 116 to the other side edge 118. The first metal portion 120 is formed of a steel, typically referred to as an alloy steel, carbon steel, or spring steel, that is heat treated to a surface hardness within the range of approximately 38 Rockwell "c" (referred to herein as "Rc") to approximately 52 Rc. The second metal portion 122 defines the cutting edge 114 and extends from approximately one side edge 116 to the other side edge 118. The second metal portion 122 is formed of a steel, typically referred to as a "high speed" or "tool" steel, that is heat treated to a surface hardness within the range of approximately 60 Rc to approximately 75 Rc.

The first metal portion 120 defines a spring-like backing that is relatively pliable, tough, and thus highly resistant to fatigue and cracking. The second metal portion 122, on the other hand, is relatively hard and highly wear resistant, and thus defines an ideal, long-lasting cutting blade. As a result, the composite utility knife blades 100 define highly wear-resistant, long-lasting cutting edges, combined with virtually unbreakable or shatter-proof backings.

The first metal portion 120 of the blade 100 is preferably made of any of numerous different grades of steel capable of being heat treated to a surface hardness within the range of approximately 38 Rc to approximately 52 Rc, such as any of numerous different alloy steels or standard AISI grades, including without limitation 6135, 6150 and D6A. The second metal portion 122, on the other hand, is preferably made of any of numerous different types of wear-resistant steel capable of being heat treated to a surface hardness within the range of approximately 60 Rc to approximately 75 Rc, including any of numerous different tool steels or high-speed steels, such as any of numerous different standard AISI grades, including, without limitation, M Series grades, such as M1, M2, M3, M42, etc., A Series grades, such as A2, A6, A7 A9, etc., H Series grades, such as H10, H11, H12, H13, etc., T Series grades, such as T1, T4, T8, etc., and W, S, O, D and P Series grades.

As may be recognized by those skilled in the pertinent art based on the teachings herein, the currently preferred materials used to construct the first and second metal portions 120 and 122 and disclosed herein are only exemplary, and numerous other types of metals that are currently known or later become known for performing the functions of the first and/or second metal portions may be equally employed to form the composite utility knife blades.

As further shown in FIG. 6, each composite utility knife blade 100 defines a pair of cut outs or notches 124 formed in the back edge 112 and laterally spaced relative to each other. As shown typically in FIG. 6, each notch 124 defines a concave, approximately semi-circular profile, and is provided to engage a corresponding locator mounted within a conventional utility knife or knife holder (not shown) in order to retain the blade. As may be recognized by those skilled in the pertinent art based on the teachings herein, the notches 124 may take any of numerous different shapes and/or configurations, and the blade may include any number of such notches or other recesses that are currently known or later become known to those skilled in the pertinent art for performing the function of engaging a conventional utility knife or holder, or the blade actuating mechanism or locator of such a holder for any and all conventional utility knives that are currently known or later become known.

As also shown in FIG. 6, the blade 100 further defines a registration aperture 126 extending through the first metal portion in an approximately central portion of the blade. The registration aperture 126 is provided to receive a blade positioning device to position the blade in a die cutter during the process of making the blades and/or for positioning the blade in a conventional utility knife. As may be recognized by those skilled in the pertinent art based on the teachings herein, the aperture 126 may take any of numerous different shapes or configurations, and the blade may include any number of such apertures or other structural features for performing the function of properly positioning the blade in a die cutting or other manufacturing apparatus, and/or for securing and/or positioning the blade within a respective utility knife handle. In addition, the alternative and/or additional aperture(s) may be located in any of numerous different locations on the utility knife blade.

As further shown in FIG. 6, the blade 100 defines a weld region 128 formed between the first and second metal portions 120 and 122, respectively, and defining an approximate line of joinder extending from one side edge 116 to the other side edge 118. The second metal portion 122 is joined to the first metal portion 120 by applying thermal energy to the interface, such as by electron beam welding, to thereby weld the first metal portion 120 to the second metal portion 122 and form a resulting weld region defining a line of joinder between the two different metal portions.

As also shown in FIG. 6, the cutting edge 114 defines an approximately straight edge extending from approximately one side edge 116 of the blade to the other side edge 118, and at least two facets (FIG. 2) formed on opposite sides of the blade relative to each other. However, the utility knife blade 100 may take any of numerous different shapes or configurations that are currently known or later become known, including, for example, a square or parallelogram shape, and can be single faceted or have more than two facets as previously noted.

Further details of the composite utility blades 100 and the manufacture of such blades are disclosed in the following patent and co-pending patent applications that are assigned to the assignee of the present invention and are hereby expressly incorporated by reference in their entireties as part of the present disclosure: U.S. Pat. No. 6,701,627 issued Mar. 9, 2004, entitled "COMPOSITE UTILITY KNIFE BLADE AND METHOD OF MAKING SUCH A BLADE"; U.S. patent application Ser. No. 10/202,703 filed Jul. 24, 2002, entitled "Composite Utility Knife Blade and Method of Making Such a Blade"; and U.S. patent application Ser. No. 10/793,593 filed Mar. 4, 2004, entitled "COMPOSITE UTILITY BLADE AND METHOD OF MAKING SUCH A BLADE".

Figure 9:
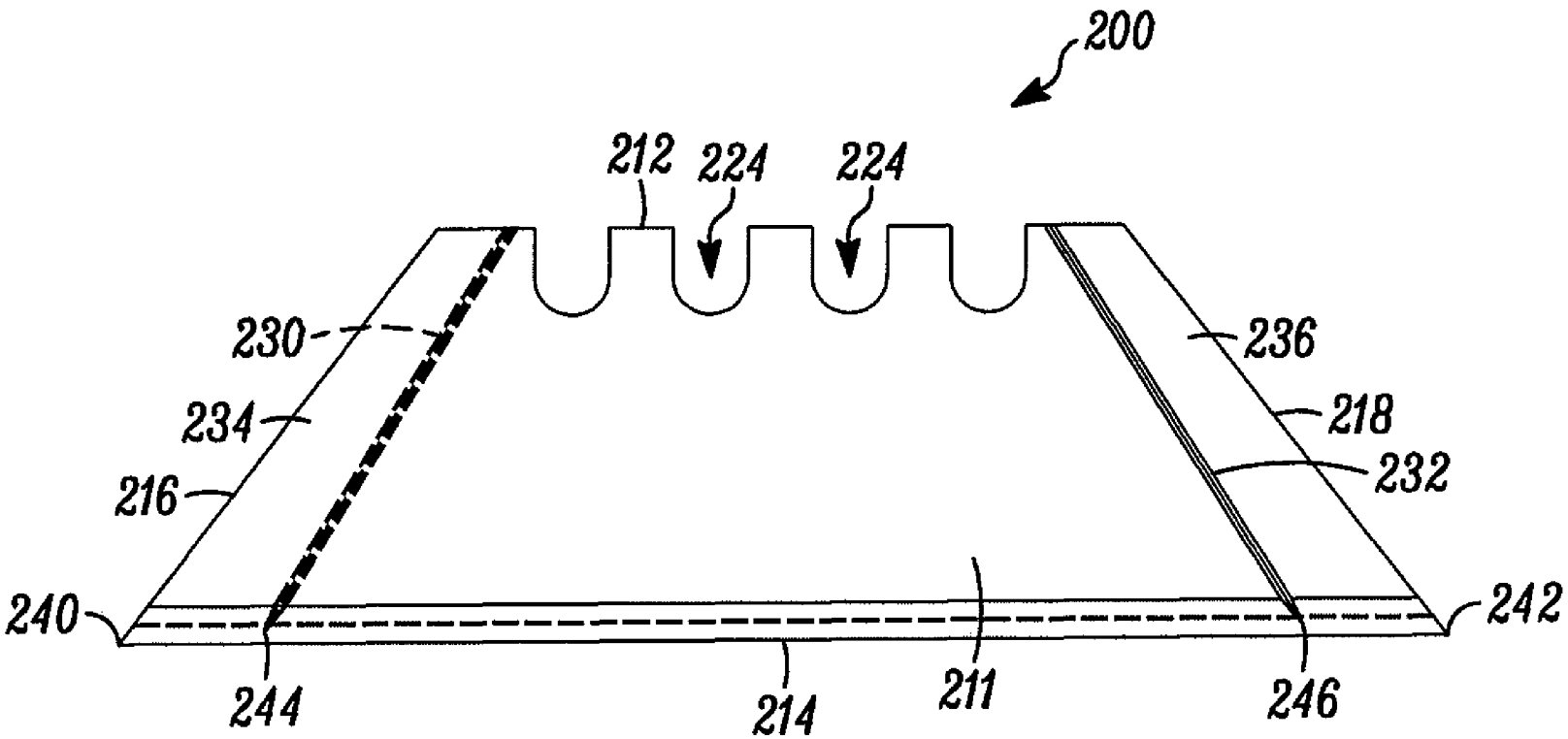
FIG. 9 is a side elevational view of another utility knife blade of the present invention including score lines at either end of the blade located on opposite sides of the blade body relative to each other.

Turning to FIG. 9, another embodiment of a utility knife blade of the present invention is indicated generally by the reference numeral 200. The utility knife blade 200 is substantially similar to the utility knife blades 10, 100 described above with reference to FIGS. 1 through 8, and therefore like reference numerals preceded by the numeral "2", or preceded by the numeral "2" instead of the numeral "1", are used to indicate like elements. A primary difference of the utility knife blade 200 in comparison to the utility knife blades 10, 100 described above, is that the score lines 230 and 232 are located on opposite sides of the blade body 211 relative to each other. More specifically, as shown in the view of FIG. 9, the score line 232 is located on the upper side of the blade, and the score line 230 is located on the underside of the blade and is shown in broken lines. As can be seen, each score line 230, 232 is formed on only one respective side of the blade, and is not formed on both or the opposing sides of the blade. When snapping off the blade segments 234, 236 at the score lines 230, 232, respectively, it is advantageous to face the respective score line away from the user and to snap or bend the blade in a direction away from the user (e.g., in a direction directed away from the user's face) such that the material defining the respective score line is placed in tension to break away the respective cutting edge segment at the score line. Accordingly, one advantage of the utility knife blade 200 of FIG. 9 is that the utility knife blade is positioned within the utility knife handle so that a user can apply substantially the same motion in substantially the same direction to snap off a blade segment (e.g., the user may consistently snap the blade toward the same hand away from his or her face), regardless of where the blade segment is located on the utility knife blade.

For example, the blade segments of these utility knife blades of the present invention may be snapped off by gripping the utility knife handle with one hand, engaging the respective blade segment with a pair of pliers in the other hand, and bending the worn blade segment at the respective score line away from the user to put the score line in tension and, in turn, snap the blade at the score line. Alternatively, the user may hold the utility knife handle in one hand, engage the tip of the utility knife blade against a work table or other support surface with the score line facing away from the user and toward the support surface, and apply a torque to the handle such that the score line is placed in tension to, in turn, snap the blade away from the user at the score line. Accordingly, a significant advantage of the utility knife blade 200 is that a user may consistently snap-off the cutting edge segments, regardless of the particular cutting edge segment or where it is located on the blade, by applying the same motion and/or placing the same side of the blade in tension. For example, in the illustrated embodiment, when holding a utility knife handle with the utility blade mounted therein, the user will consistently place the right-hand side of the blade in tension to snap off the exposed blade segment. Yet another advantage of this configuration is that the score line of the exposed cutting edge segment is consistently located on the same side of the utility knife handle, thereby making it intuitive for the user to consistently snap off the used blade segments in the correct direction.

Figure 10:
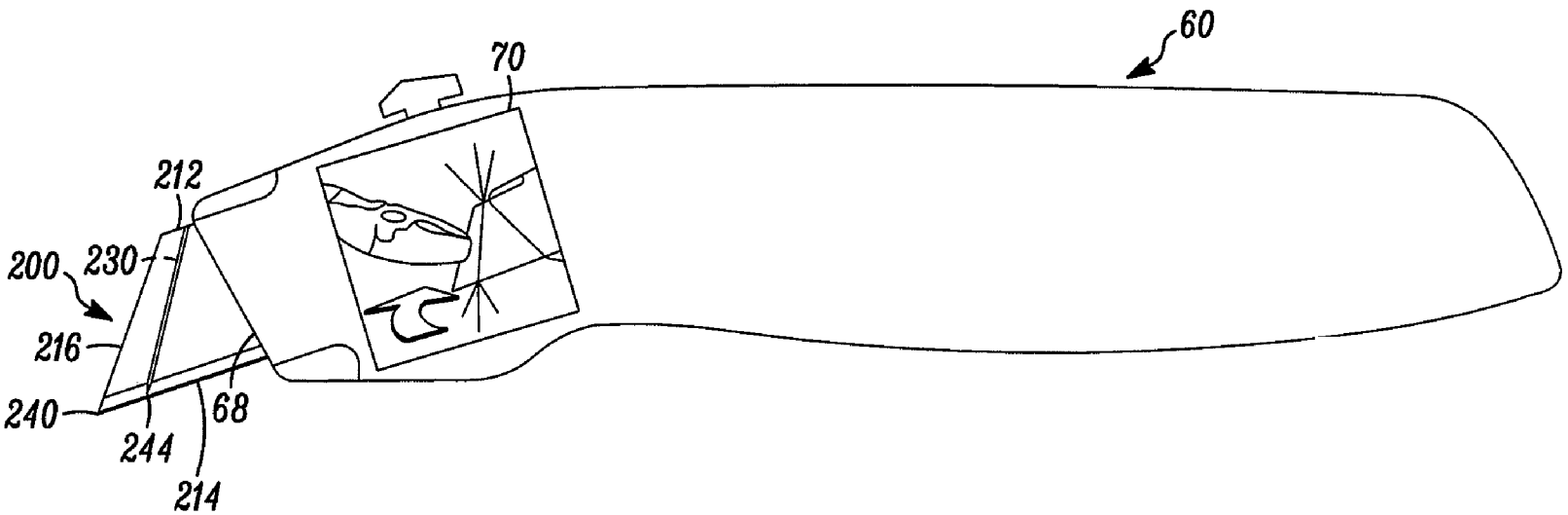
FIG. 10 is a side elevational view of an embodiment of a utility knife including thereon a marking for instructing a user on positioning the handle and blade and snapping a cutting edge segment therefrom.

If desired, a marking may be placed on the utility knife blade, and/or on the utility knife handle, to facilitate proper positioning of the utility knife blade and/or utility knife handle, for snapping the worn blade segments or tips from the blade. For example, in the illustrated embodiment of FIG. 9, the left-hand side of the utility knife blade and/or of the utility knife handle may be marked to instruct the user to face or view that side of the blade and/or handle during snapping to ensure that the right-hand side of the blade and the material of the respective score is placed in tension when snapping the worn segment or tip from the blade. As shown in FIG. 10, an exemplary such utility knife handle 68 includes thereon a marking 70. In the illustrated embodiment, the marking 70 defines a graphic illustration showing the blade 200 extending from the nose of the utility knife handle 68, a tool for engaging the worn cutting edge segment (e.g., a pliers), the relative positioning of the tool and score, and an arrow showing the direction for bending the cutting edge segment about the score to place the score in tension and, in turn, snap in a preferred manner the cutting edge segment from the blade. The marking 70 may be printed on a label that is fixedly secured to the utility knife handle, or may be formed on the handle, such as by die casting, molding or otherwise forming the marking on the handle. In the latter situations, the marking preferably will take the form of a simplified or compact line drawing, or other simplified illustration. If desired, the marking may take the form of raised lines or other relatively raised and correspondingly recessed surface features on the side of the handle in the region of the nose to form a thumb grip, or location for a thumb or other finger during snapping of a cutting edge segment from the blade.

As may be recognized by those of ordinary skill in the pertinent art based on the teachings herein, the marking may take any of numerous different forms and/or configurations, and may be applied at any of numerous different locations on the utility knife handle and/or blade, that are currently known, or that later become known. For example, if desired, another marking, such as a colored dot or other colored indicia, a mark formed by scoring or scribing, or other visible indicia, may be applied to the blade, and may be located, for example, on the opposite side of the blade relative to the score, to facilitate ensuring that the user will view the marking, and thus face the score away from the user, during snapping of the respective cutting edge segment(s) from the blade. In the illustrated embodiments, the markings show the location of the score, the direction of the break (by, for example, the curved arrow and lines emanating from the score), that a tool, such as pliers, is the preferred method of grasping the spent tip, and the tool position relative to the score.

Figure 11:
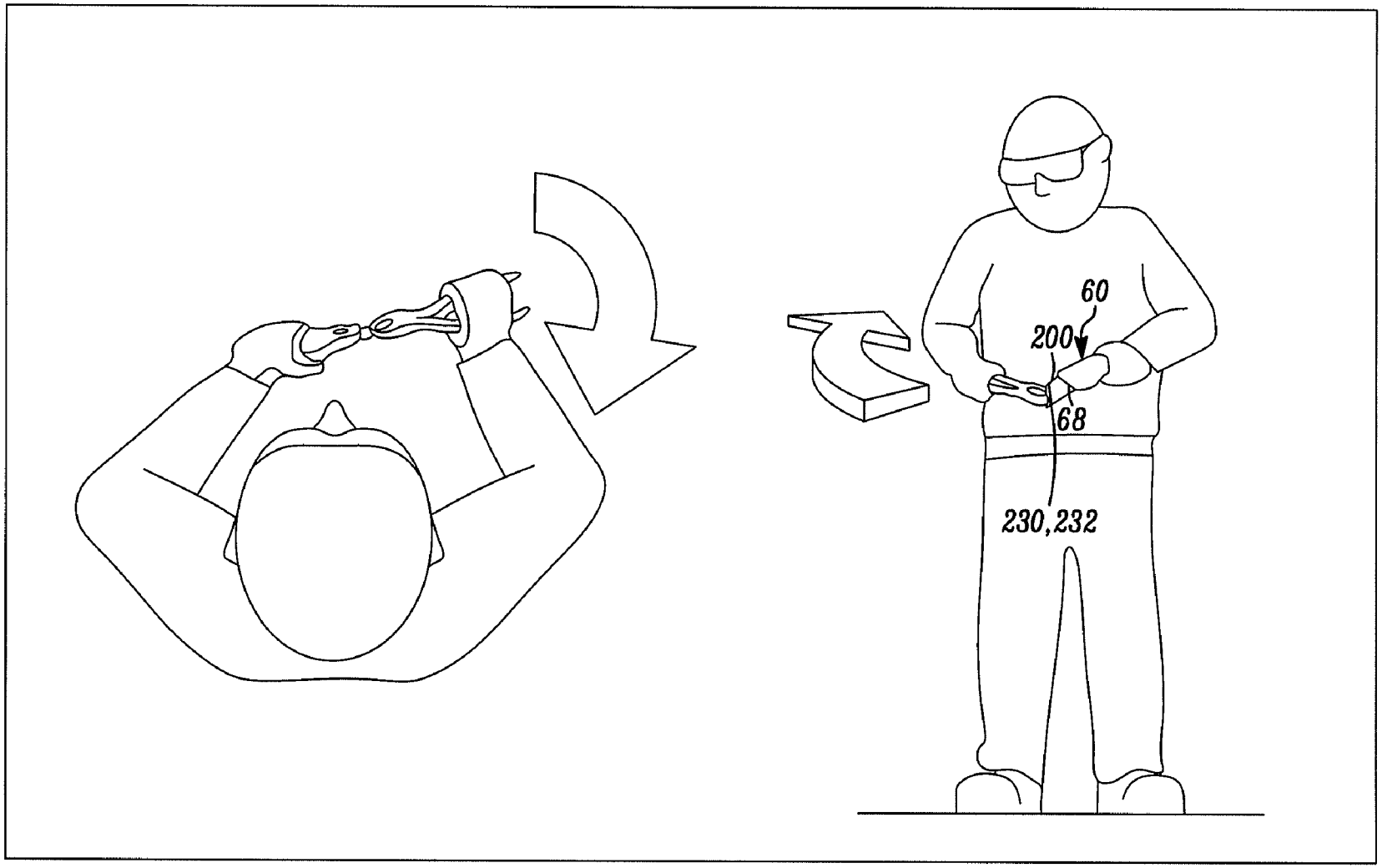
FIG. 11 includes two additional forms of marking a utility knife handle for instructing a user on positioning the handle and blade and snapping a cutting edge segment therefrom.

Turning to FIG. 11, an alternative form of marking may include an illustration of a user wearing safety glasses or goggles, and the preferred manner for holding the utility knife handle and snapping worn cutting edge segments from the blade. In the embodiment of FIG. 11, the marking shows the preferred manner of facing the score away from the user and bending the blade about the score to place the score in tension and, in turn, snap the blade at the score. If desired, the illustration on the left-hand side of FIG. 11 may appear on the top (or upper spine) of the handle, and the illustration on the right-hand side of FIG. 11 may appear on the side in the nose region of the handle (i.e., the location of the marking 70 in FIG. 10). Another advantage of these configurations is that it may be difficult for the user to see the score line, and therefore locating the exposed score on the same side of the handle for all blades facilitates ensuring that users will consistently apply the same motion to snap off the blade segments, and in doing so, will consistently snap the blade segments by placing the respective score lines in tension.

Although the utility knife blade 200 includes four notches 224 that are substantially equally spaced relative to each other in the back edge 212 of the blade, any desired number of such notches, that may define any of numerous different notch configurations, equally may be employed. Similarly, the score lines may define any of the configurations described above, including one or more score lines that intersect the respective side edges, that intersect the corner of the back edge and respective side edge, and/or that are substantially perpendicular to the cutting edge. Further, although the illustrated score lines define a v-shaped cross-sectional configuration, the score lines may define any of numerous different score line cross-sectional configurations that are currently known, or that later become known. Still further, although the utility knife blade 200 includes two scores and four notches, the utility knife blades of the present invention may include any desired number of score lines and notches, in any of numerous different configurations, including without limitation, only one score line, three score lines (i.e., two on one side of the blade and one on the other side of the blade), four score lines (i.e., two pairs formed on opposites sides of the blade relative to each other), or more than four score lines. Similarly, the utility knife blades of the present invention with more than one score line may include only two notches, or may include notches or other utility knife engaging features located on a portion of the blade other than the back edge as shown.

As may be also recognized by those skilled in the pertinent art based on the teachings herein, the utility blades of the present invention may be made of any of numerous different materials that are currently known or that later become known, such as conventional carbon steel, bi-metal or other composite constructions, and/or may include any of numerous different coatings, such as wear-resistant coatings and/or decorative coatings.

Accordingly, as may be recognized by those skilled in the pertinent art based on the teachings herein, numerous changes and modifications may be made to the above-described and other embodiments of the utility knife blades of the present invention without departing from the scope of the invention as defined in the appended claims. For example, as shown in FIGS. 2, and 4-8, the blades may take any of numerous different shapes and/or configurations and the notches and score lines may be altered as previously noted. Similarly, the cutting tips may define any of numerous different cutting tip shapes that are currently known, or that later become known, including perpendicular-edge tips, rounded tips or angled tips. In addition, the score lines may be formed on only the respective sides of the blades as shown, for example, in FIG. 9, or may be formed in pairs, wherein each pair of score lines is formed on opposite sides of the blade relative to each other, and each pair of score lines is aligned with each other to define the same break line on the blade. Accordingly, this detailed description of preferred embodiments is to be taken in an illustrative, as opposed to a limiting sense.

What is claimed is:

1. A utility knife blade including a blade body defining an upper side, an underside opposite the upper side, a back edge, a cutting edge located on an opposite side of the blade relative to the back edge, a first side edge extending between the back and cutting edges of the blade, a second side edge located on an opposite side of the blade relative to the first side edge, a first score line located on the upper side of the blade body proximate to the first side edge and defining a first cutting edge segment between the first score line and the first side edge and extending between the back and cutting edges of the blade, and a second score line located on the underside of the blade body proximate to the second side edge of the blade and defining a second cutting edge segment between the second score line and the second side edge.

2. A utility knife blade as defined in claim 1, wherein the back edge, cutting edge and first and second side edges define a substantially trapezoidal periphery.

3. A utility knife blade as defined in claim 1, wherein the utility knife blade defines only the first and second score lines and no other score lines.

4. A utility knife blade as defined in claim 1, further including at least one of (i) a plurality of first score lines laterally spaced relative to each other on the upper side of the blade body, and (ii) a plurality of second score lines laterally spaced relative to each other on the underside of the blade body.

5. A utility knife blade as defined in claim 1, wherein each score line defines a cutting point approximately at the intersection of the respective score line and the cutting edge, the utility knife blade further defines a plurality of notches laterally spaced relative to each other and configured for receiving therein a locator of a utility knife handle for locating the blade within the utility knife handle, and each notch corresponds to a respective cutting point for locating the respective cutting point relative to a blade aperture of the utility knife handle.

6. A utility knife blade as defined in claim 5, wherein each notch is spaced approximately the same distance from its respective cutting point as every other notch.

7. A utility knife blade as defined in claim 5, further comprising four notches and four cutting points, wherein each of the four notches is spaced approximately the same distance from its respective cutting point as the other notches.

8. A utility knife blade as defined in claim 5, wherein the plurality of notches are laterally spaced relative to each other along the back edge of the blade.

9. A utility knife blade as defined in claim 1, wherein each of the first and second score lines one of: (i) intersects the first or second side edge, respectively, (ii) intersects the corner of the back edge and the first or second side edge, respectively, and (iii) intersects the back edge.

10. A utility knife blade as defined in claim 9, wherein at least one of the first and second score lines is approximately perpendicular to the cutting edge.

11. A utility knife blade as defined in claim 1, in combination with a utility knife handle, wherein at least one of the utility knife blade and the utility knife handle defines a marking thereon indicating the direction to face each score line when snapping a blade at the respective score line.

12. A utility knife blade as defined in claim 11, wherein each score line exposed through a blade aperture in the utility knife handle is located on a first side of the handle or blade, and the marking is located on a second side of the handle or blade that is opposite to the first side.

13. A utility knife blade as defined in claim 12, wherein each score line exposed through the blade aperture in the utility knife handle is located on a right-hand side of the handle or blade, and the marking is located on a left-hand side of the handle or blade.

14. A utility knife blade and handle as defined in claim 11, wherein the marking defines an illustration of a tool engaging a cutting edge segment and the position of the score line relative to a user.

15. A utility knife blade including a blade body defining an upper side, an underside opposite the upper side, a back edge, a cutting edge located on an opposite side of the blade relative to the back edge, a first side edge extending between the back and cutting edges of the blade, a second side edge located on an opposite side of the blade relative to the first side edge and extending between the back and cutting edges of the blade, first means located on the upper side of the blade body proximate to the first side edge of the blade for defining a first cutting edge segment between the first means and the first side edge and for breaking away the first cutting edge segment from the blade, and second means located on the underside of the blade body proximate to the second side edge of the blade and defining a second cutting edge segment between the second means and the second side edge and for breaking away the second cutting edge segment from the blade.

16. A utility knife blade as defined in claim 15, wherein the first means is a first score line, and the second means is a second score line.

17. A utility knife blade as defined in claim 15, further comprising means for marking at least one of the utility knife blade and a utility knife handle holding the blade and identifying the direction to face the blade when snapping the blade at the first and second means.

18. A utility knife blade as defined in claim 15, wherein each side edge defines a respective cutting point at the juncture of the respective side edge and the cutting edge, each of the first and second means defines a respective cutting point at the juncture of the respective first or second means and the cutting edge, and the utility knife blade further includes means for positioning each cutting point approximately the same distance from a blade aperture of a utility knife handle.

19. A utility knife blade as defined in claim 18, wherein the means for positioning includes a plurality of blade positioning apertures laterally spaced relative to each other at the back edge of the blade, each aperture corresponds to a respective cutting point, and each aperture is located approximately the same distance from its respective cutting point as the other apertures.

20. A utility knife blade as defined in claim 15, further including at least one of (i) a plurality of first means laterally spaced relative to each other on the upper side of the blade body, and (ii) a plurality of second means laterally spaced relative to each other on the underside of the blade body.

21. A utility knife blade as defined in claim 15, wherein the blade body defines a conventional trapezoidal blade envelope for use in conventional retractable and fixed blade utility knives including a height that is within the range of about ¾ inch±about 1/16 inch, a length of the cutting edge that is within the range of about 2½ inch±about ¼ inch, a side edge angle that is within the range of about 45° to about 55°; and a thickness that is within the range of about 0.015 inch to about 0.05 inch.

22. A method comprising the following steps:

providing a utility knife blade defining a conventional trapezoidal blade envelope for use in a conventional retractable or fixed blade utility knife defining a blade aperture, wherein the utility knife blade defines a plurality of score lines including a first score line located on an upper side and first end of the blade, and a second score line located on an underside and second end of the blade opposite the upper side and first end of the blade, respectively, and each score line defines a respective cutting edge blade segment;

locating each score line exposed through the blade aperture of the utility knife on the same side of the utility knife regardless of which end of the utility knife blade is exposed through the blade aperture; and snapping each blade segment away from the blade by placing the respective score line in tension.

23. A method as defined in claim 22, further comprising snapping each blade segment away from the blade by bending the blade segment about, and facing the respective score away from a user.

24. A method as defined in claim 22, further comprising providing a marking on at least one of the utility knife blade and a handle therefor indicating a preferred direction of break at each respective score line.

* * * * *